United States Patent [19]

Briner et al.

[11] 4,200,038

[45] Apr. 29, 1980

[54] CHIMNEY TOP ASSEMBLY

[75] Inventors: Clifton Briner, Huntington; George Alexander, Fort Wayne, both of Ind.

[73] Assignee: American Standard Inc., New York, N.Y.

[21] Appl. No.: 936,542

[22] Filed: Aug. 23, 1978

[51] Int. Cl.[2] ..... F23L 17/02

[52] U.S. Cl. ..... 98/84; 98/81

[58] Field of Search ..... 126/120, 121; 98/60, 98/58, 66, 67, 70, 79, 81, 83, 84

[56] References Cited

U.S. PATENT DOCUMENTS

| | | | |
|---|---|---|---|
| 215,279 | 5/1879 | Moore | 98/84 |
| 3,874,363 | 4/1975 | Biedenbender et al. | 98/58 X |
| 3,888,231 | 6/1975 | Galluzzo et al. | 126/120 |
| 4,003,362 | 1/1977 | Lener | 126/121 |
| 4,069,668 | 1/1978 | Oldberg | 98/84 X |

FOREIGN PATENT DOCUMENTS

| | | | |
|---|---|---|---|
| 18502 | 10/1955 | Fed. Rep. of Germany | 98/84 |
| 668186 | 10/1929 | France | 98/84 |
| 1046952 | 12/1953 | France | 98/84 |

*Primary Examiner*—Albert J. Makay

*Assistant Examiner*—Harold Joyce

*Attorney, Agent, or Firm*—James J. Salerno, Jr.; Robert G. Crooks

[57] ABSTRACT

A chimney top assembly adapted to be mounted to the exit end of a chimney flue of the type utilized for fireplaces. The chimney top assembly allows hot combustion gases to escape through the assembly with the least resistance to its flow while providing maximum resistance to rain entry into the chimney flue. The assembly includes a divergent nozzle having a flared open outer end and an open inner end which is adapted to be coupled to the exit end of the chimney flue. The flared open outer end diverges at an angle from the axis of the chimney flue insufficient to cause separation of flue gases exiting therefrom and a baffle or rain cap is mounted at a predetermined spaced distance above the open outer end of the divergent nozzle whereby a significant portion of the energy normally lost by flue gases exiting from the chimney flue is recovered. The use of such an assembly decreases the possibility of fireplace smoking, increases the safety of the fireplace system, and allows the use of a smaller diameter more compact piping system.

1 Claim, 1 Drawing Figure

CHIMNEY TOP ASSEMBLY

BACKGROUND OF THE INVENTION

This invention is directed to a chimney top assembly adapted to be mounted to the exit end of chimney flue which allows hot combustion gases through the chimney top assembly with the least amount of resistance to its flow while maximum resistance to rain entry into the chimney flue is achieved.

Chimney top assemblies of varying designs are known in prior art. The chimney top designs do not overcome the problem of energy loss of the exiting combustion gas stream from the chimney flue. Although some designs employ rain caps such as shown in U.S. Pat. No. 3,282,194 they do not recover the energy loss of the exiting flue gases. Also, the prior art designs do not overcome the problems of fireplace smoking and flame-out. Illustrative of such designs are disclosed in the U.S. Patents listed below:

| PATENT NUMBER | DATE OF ISSUE | INVENTOR |
|---|---|---|
| 9,196 | Aug. 17, 1852 | J. Leed, et al |
| 410,660 | Sept. 10, 1889 | I. J. Turner |
| 1,716,223 | June 4, 1929 | E. W. Frendahl |
| 2,423,672 | July 8, 1947 | D. F. Zucker |
| 3,282,194 | Nov. 1, 1966 | R. D. Thulman |
| 3,384,001 | May 21, 1968 | M. M. Mathis |
| 3,817,162 | June 18, 1974 | G. T. Guelph |

The Frendahl patent noted above describes a ventilator which prevents the usual downdraft of air and creates a siphoning effect on the air which improves the ventilation of a room or building.

SUMMARY OF THE INVENTION

It is an object of the invention to provide a chimney top assembly which minimizes draft losses, increases the combustion flue gas flow rate through the chimney flue and minimizes downdraft of smoke from the chimney flue.

Another object of the invention is to provide a chimney top assembly arranged and constructed to be mounted on the exit end of a triple walled thermosiphoning chimney to improve the cooling air flow rate through the thermosiphoning passages while increasing the combustion flue gas flow rate therethrough.

Another object of the invention is to provide a chimney top assembly capable of utilizing a chimney flue of a reduced diameter while providing a combustion gas flow capacity equal to or greater than a chimney flue of a larger or standard diameter but without the chimney top assembly of the present invention.

A further object of the invention is to provide a chimney top assembly having a nozzle portion in which the flared open outer end of the nozzle diverges at an angle from the axis of the chimney flue insufficient to cause separation of flue gas exiting therefrom.

A further object of the invention is to provide a chimney top assembly which allows hot combustion gases to escape therethrough with the least resistance to its flow while providing maximum resistance to rain entry into the chimney flue.

Still a further object of the invention is to provide a chimney top assembly which is inexpensive to manufacture and which is easy to install without additional labor costs.

These and other objects of the invention are accomplished by providing an improved and novel chimney top assembly which is adapted to be mounted on the exit end of a chimney flue. The assembly includes a divergent nozzle having a flared open outer end and an inner end adapted to be mounted to the exit of a chimney flue. The flared open outer end diverges at an angle from the axis of the chimney flue insufficient to cause separation of flue gases exiting therefrom. A housing having an open outer end extends above the open outer end of the nozzle and is positioned therearound. Both the housing and divergent nozzle have means for mounting the chimney assembly to the chimney flue. A baffle or rain cap is mounted a predetermined spaced distance above the open outer end of the divergent nozzle and the open outer end of the housing whereby the energy which is normally lost by the exiting flue gases is recovered.

In a preferred form of the invention, the chimney top assembly is arranged and constructed to be mounted on the exit end of a triple walled chimney flue assembly of the thermosiphonic type such as is disclosed in U.S. Pat. No. 2,634,720 to R.R. Thulman, granted Apr. 14, 1953.

According to the invention, the chimney top assembly is capable of reducing the exit loss by recovering, to the combustion gas stream, a significant portion of the energy which is normally lost with present chimney top termination designs. Every moving fluid stream has energy which is a result of its movement. This energy content is proportional to the square of the fluid velocity, i.e: flue gas velocity. When moving stream of fluid leaves the boundary of a system, i.e. a chimney top assembly, the energy contained in the fluid at that point is lost from the system and is dissipated to the atmosphere. The divergent nozzle used in the present allows a recovery of a large proportion of this energy before the combustion gases leave the chimney system and therefore reduces the energy loss associated with the chimney top or termination assembly. The advantages of the present invention achieves unexpected reductions in loss coefficients for chimney terminations, the draft of the chimney system is greatly improved and the possibility of a chimney system being subject to downdraft or smoking is substantially reduced.

DESCRIPTION OF THE DRAWING

In the drawing, FIG. 1, the chimney top assembly of the present invention is shown is side elevation partially broken away.

DESCRIPTION OF THE EMBODIMENT

Figure 1:
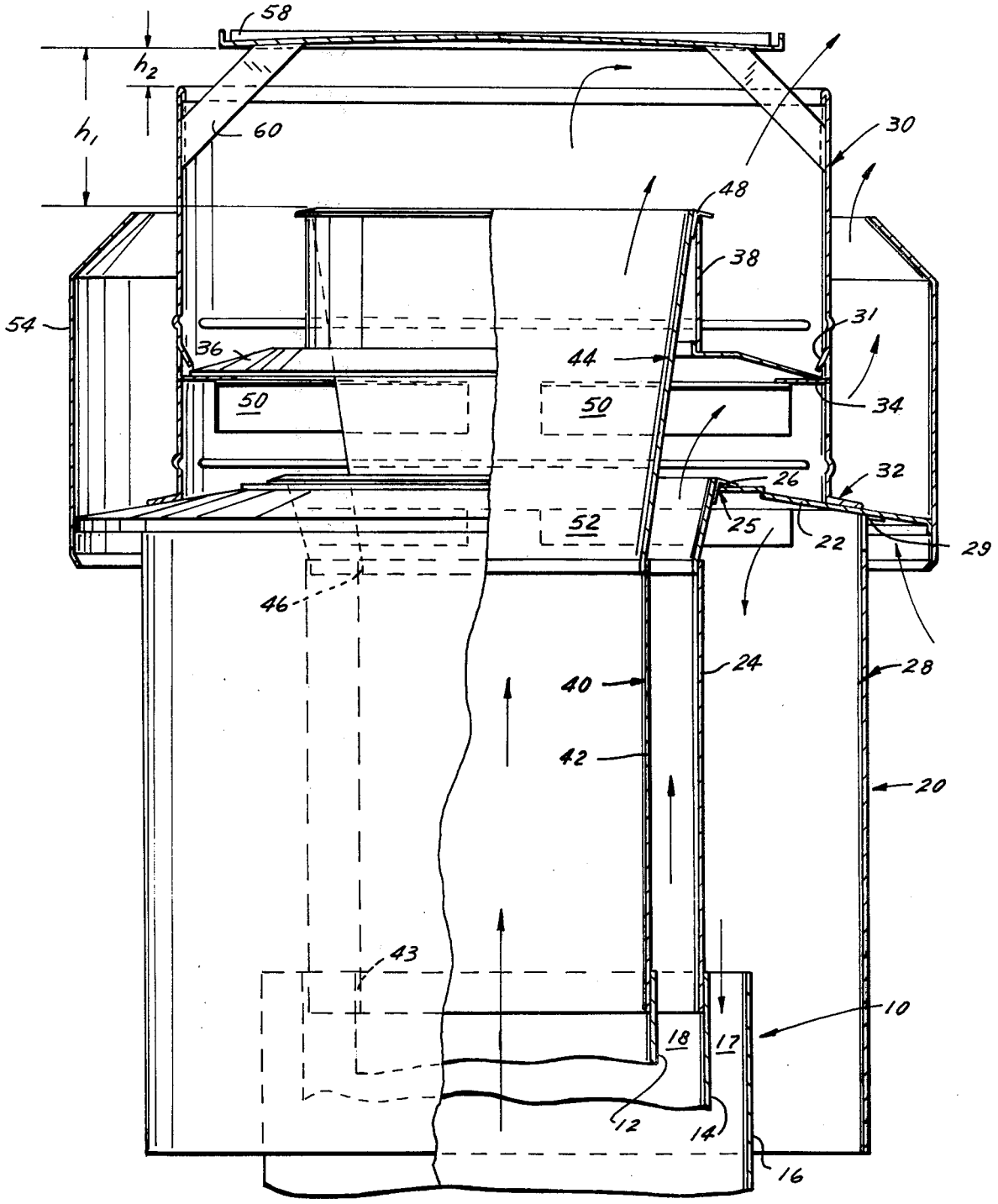

In the drawing, FIG. 1, chimney 10 includes an arrangement of concentric pipes or casings in which the innermost pipe 12 referred to as the flue pipe carries away the combustion gases from an appliance such as a fireplace. The intermediate pipe 14 and outer pipe or casing 16 circulate cooling air from the outer passageway 17 through the air cooling passageway 18 as shown by the direction of the arrows of FIG. 1.

Chimney top assembly 20 of FIG. 1 is illustrative of one form of a chimney top used for a triple-walled chimney although other designs are available. Assembly 20 includes an inner cone support 22 which is in the form of a curved collar and permits rain to be directed downwardly and away from assembly 20. An intermediate pipe section 24 is telescopically positioned in intermediate pipe 14 with its upper end being flared and coupled to the inner rim edge 25 of inner cone support 22 by a plurality of circumferentially spaced brackets 26 and rivets, not shown.

A lower housing 28 is coupled to the undersurface of inner cone support 22 adjacent to its outer end by rivets, not shown. Lower housing 28 surrounds chimney 10 and may be finished in a decorative fashion such as simulated brick. The upper rim edge of housing 28 may be flanged at 29 so that a plurality of rivets not shown will secure inner cone support 22 thereto. Flanged rim 32 is formed at the lower end of upper housing 30 so that rim 32 seats on inner cone support 22 adjacent the outer end thereof. Rim 32 is held in place on inner cone support 22 by a plurality of rivets, not shown. Upper collar retaining means 34 is formed between the upper and lower ends of housing 30 to provide means for holding upper pan 36 in spaced relation above inner cone support 22. Upper pan 36 is in the form of a curved collar to permit rain to be directed downwardly and away from assembly 20. Mounted to the inner rim edge of upper pan 36 is a cylindrical skirt 38.

Divergent nozzle or flue cone 40 includes a lower cylindrical section 42 in which one end 43 is telescopically received in flue pipe 12. The upper nozzle section 44 diverges outwardly at its open outer end and is coupled to the upper end 46 of lower section 42 as by welding or by forming a folded seam commonly used in the art. The open outer end of the upper nozzle section 44 has a plurality of angle flanges 48 so that flue cone 40 rests on top of skirt 38 as shown in FIG. 1. Upper pan 36 is held in place by latch means 31 in the form of detents which are pressed through upper housing 30 so that pan 36 snaps into place within upper housing 30 and held on retaining means 34. The openings formed by detents 31 may also serve as weepholes to permit collected rain water to drain away from chimney assembly 20.

Upper housing 30 is formed having a plurality of passageway openings 50 which extends around the housing 30 and communicate with cooling air passageway 18 of chimney 10. This is shown most clearly by the direction of the arrows in FIG. 1 which indicates the path for cooling air which is expelled from thermosiphonic chimney 10. A second set of openings 52 are formed along the upper edge of lower housing 28 and communicate with outside air passageway 17 of chimney 10. This is shown most clearly by the direction of the arrows in FIG. 1 which indicates the path for the outside air which is introduced into thermosiphonic chimney 10. A decorative collar 54 is mounted at one end to the upper section of lower housing 28 with its upper end being spaced from upper housing 30 to permit air cooling air passageway 18 to be discharged into the surrounding atmosphere.

A rain cap 58 is positioned above the outer open end of divergent nozzle 40 and the open rim of housing 30 a predetermined distance so that hot combustion gases being expelled through the chimney exit are released with the least amount of resistance to its flow. Rain cap 58 is held in place by a plurality of braces 60 which are spaced around the upper rim edge of upper housing 30. One end of each brace 60 is held to upper housing 30 by screws not shown and rain cap 58 is mounted to the other end of brace 60 by rivets, not shown.

In chimney top assembly 20 of FIG. 1, chimney flue 12 of thermosiphonic chimney 10 was 8 inches in diameter. It was found that the least amount of resistance to the flow of escaping flue gases through the chimney top exit could be achieved by maintaining a predetermined distance between rain cap 58, divergent nozzle 40 and upper housing 30. Part of this relationship is shown in FIG. 1 as the distance $h_1$, i.e., the space between the top rim of divergent cone 40 and rain cap 58. The other relationship is the space, $h_2$, i.e., the distance between the top rim of upper housing 30 and rain cap 58. It has been found that the distance the rain cap 58 extends above the housing 30, $h_2$, be not less than 1/10 the diameter of the outlet of the nozzle section 44. The distance the rain cap 58 extends above the divergent cone 40, $_1$, be not less than ⅓ the diameter of the outlet of the nozzle section 44. In the embodiment of FIG. 1, the best results achieved in the relationship of $h_1$ and $h_2$ was where $h_1$ was 4 ½inches to 5 ½inches and $h_2$ was 1 inch to 1 ½inches with a nozzle section outlet diameter of approximately 10 ½inches.

While the preferred form of the invention has been shown and described herein with respect to FIG. 1, it should be realized that there may be many modifications, alterations and substitutions may be made thereto without departing from the invention herein.

What is claimed:

1. A chimney top assembly capable of recovering the energy which is normally lost by the exiting flue gases and which is adapted to be mounted to the exit end of a chimney flue or the exit end of a thermosiphoning chimney flue comprising:

a divergent nozzle having a first outwardly tapered section and an open outer end, said tapered section diverging at an angle of up to about 15°, and having a second section adapted to be coupled to the exit end of a chimney flue;

a housing having an open outer end which is spaced from and surrounds said divergent nozzle section with its open outer end and extending above the open outer end of said nozzle section;

said housng and said divergent nozzle having means for mounting said chimney assembly to said chimney flue;

a rain cap mounted above the open outer end of said housing with the perimeter of said rain cap being spaced from the open outer end of said housing so as to define an annular space between said rain cap and said housing;

a baffle surrounding said divergent nozzle section positioned between the open outer end of said housing and the exit end of said chimney flue to block off ambient air from said annular space between said rain cap and said housing;

said rain cap being positioned a predetermined distance above the open outer end of said divergent nozzle and the open outer end of said housing to direct exiting flue gases divergently outwardly of said nozzle and housing while recovering energy normally lost by said exiting flue gases through the exit end of said flue; and said rain cap extending a distance above said open outer rim of said housing of not less than 1/10 the diameter of the outlet of the nozzle section and from the rain cap a distance above the nozzle outlet of not less than 1/3 the diameter of the outlet of the nozzle section.

* * * * *